US008591182B2

(12) United States Patent
Morgenstern et al.

(10) Patent No.: US 8,591,182 B2
(45) Date of Patent: Nov. 26, 2013

(54) DEVICE FOR SUSPENDING GUIDE BLADES

(75) Inventors: Stefan Morgenstern, Munich (DE); Rudolf Stanka, Rattenkirchen (DE)

(73) Assignee: MTU Aero Engines GmbH, Munich (DE)

( * ) Notice: Subject to any disclaimer, the term of this patent is extended or adjusted under 35 U.S.C. 154(b) by 1603 days.

(21) Appl. No.: 10/585,162

(22) PCT Filed: Dec. 15, 2004

(86) PCT No.: PCT/DE2004/002745
§ 371 (c)(1),
(2), (4) Date: Jun. 30, 2006

(87) PCT Pub. No.: WO2005/066462
PCT Pub. Date: Jul. 21, 2005

(65) Prior Publication Data

US 2008/0292457 A1 Nov. 27, 2008

(30) Foreign Application Priority Data

Jan. 9, 2004 (DE) ..... 10 2004 001 393

(51) Int. Cl.
*F01D 9/04* (2006.01)
*F01D 25/24* (2006.01)

(52) U.S. Cl.
USPC ..... 415/189; 415/138; 415/209.3; 415/213.1

(58) Field of Classification Search
USPC ..... 415/213, 136, 138, 139, 190, 415/209.2–209.4
See application file for complete search history.

(56) References Cited

U.S. PATENT DOCUMENTS

| | | | | | |
|---|---|---|---|---|---|
| 2,995,294 | A | | 8/1961 | Warnken | 230/132 |
| 3,043,103 | A | | 7/1962 | Dent et al. | 60/35.6 |
| 3,104,091 | A | | 9/1963 | Vivian | 253/39 |
| 4,361,010 | A | * | 11/1982 | Tanrikut et al. | 60/757 |
| 4,655,682 | A | | 4/1987 | Kunz et al. | 415/119 |
| 4,832,568 | A | * | 5/1989 | Roth et al. | 415/189 |
| 4,868,963 | A | | 9/1989 | Corsmeier et al. | 29/156.8 R |
| 5,069,034 | A | * | 12/1991 | Jourdain et al. | 60/766 |
| 5,435,139 | A | * | 7/1995 | Pidcock et al. | 60/757 |
| 6,041,590 | A | * | 3/2000 | Hayton et al. | 60/766 |
| 2002/0197153 | A1 | * | 12/2002 | Rogers | 415/137 |

FOREIGN PATENT DOCUMENTS

EP 0 843 090 5/1998

* cited by examiner

*Primary Examiner* — Edward Look
*Assistant Examiner* — Jesse Prager
(74) *Attorney, Agent, or Firm* — Davidson, Davidson & Kappel, LLC

(57) ABSTRACT

A device (10) for suspending gas channel elements, in particular for suspending guide blades or guide blade segments or gas channel segments, on a housing of a gas turbines is provided. The device comprises first plate-shaped elements (11, 12, 13, 14) and second plate-shaped elements (15, 16, 17), whereby the first plate-shaped elements (11, 12, 13, 14) and the second plate-shaped elements (15, 16, 17) are connected together by web-like elements (18) which extend in an essentially perpendicular manner in relation to the first and second elements and form a meandering or crenelated profile.

1 Claim, 3 Drawing Sheets

DEVICE FOR SUSPENDING GUIDE BLADES

FIELD OF THE INVENTION

The present invention relates to a device for suspending gas channel elements.

BACKGROUND

Gas channel elements, such as guide blades, guide blade segments, gas channel plates, or gas channel plate segments, are used among other things for forming a flow channel or gas channel of the gas turbine and must be suspended or mounted on the housing of the gas turbine. The first ends of the gas channel elements, e.g., the guide blades, protrude into the gas channel and their second ends are attached to the housing of the gas turbine. The gas channel elements are attached to the housing via a device for suspending gas channel elements which may also be referred to as a suspension device or a suspension element.

The gas channel elements, in particular the guide blades protruding into the gas channel, are subjected to extreme thermal stress, in particular in the area of the high-pressure turbine of the gas turbine. The gas channel elements are thus heated to high temperatures in particular in the area of the high-pressure turbine. In contrast, the housing is relatively cold and thus has a lower temperature. The suspension elements for suspending gas channel elements on a housing of a gas turbine are therefore in contact with the relatively hot gas channel elements and with the relatively cold housing. Therefore, a high temperature gradient is formed in the suspension devices or suspension elements, thereby exposing them to extreme thermal stresses. This may result in stress cracks within the suspension devices and consequently in a reduced service life.

The devices for suspending gas channel elements on a housing of a gas turbine known from the related art can only inadequately absorb the above-mentioned thermal stresses due to the differences between the relatively cold housing of the gas turbine and the relatively hot gas channel elements. The devices for suspending gas channel elements thus have a limited service life.

SUMMARY OF THE INVENTION

Based on this, an object of the present invention is to create a novel device for suspending gas channel elements.

In accordance with an embodiment of the present invention, a device for suspending gas channel elements on a housing of a gas turbine comprises a plurality of first plate-shaped elements connected to a plurality of second plate-shaped elements. The first plate-shaped elements and the second plate-shaped elements are connected to one another only by web-like elements and each web-like element extends approximately perpendicularly to the first and second plate shaped elements to which it is connected and forms a crenelated profile extending in a circumferential direction of the housing. Preferably, a length of the web-like element in the circumferential direction being greater, by a multiple greater than one, than a width of the web-like element in an axial direction.

By using the device according to the present invention for suspending gas channel elements it is achieved that the thermal expansion of the gas channel elements is not transferred to the device according to the present invention in such a way that the service life of the device according to the present invention is reduced. Moreover, the shape of the device according to the present invention is selected in such a way that different degrees of expansion within the device according to the present invention in the contact area of the relatively cold housing and in the contact area of the relatively hot gas channel are absorbed by avoiding a rigid ring structure in such a way that stresses due to the different thermal expansions are negligible and the service life of the device according to the present invention is thus not affected.

According to an advantageous refinement of the present invention, a second plate-shaped element is positioned between two adjacent first plate-shaped elements in such a way that the opposite ends of the second plate-shaped element are connected to each of the two adjacent first plate-shaped elements via a web-like element. The web-like elements advantageously extend over the entire width of the first plate-shaped elements and/or the second plate-shaped elements.

According to an advantageous refinement of the present invention, boreholes are introduced into the first plate-shaped elements into which bolt-like fastening elements are insertable on the housing side for the connection to the housing of the gas turbine. For the connection to the gas channel element or each gas channel element, the second plate-shaped elements are insertable into recesses assigned to projections of the gas channel elements.

BRIEF DESCRIPTION OF THE DRAWINGS

Exemplary embodiments of the present invention are explained in greater detail based on the drawing, without being restricted thereto.

DETAILED DESCRIPTION

Figure 1:
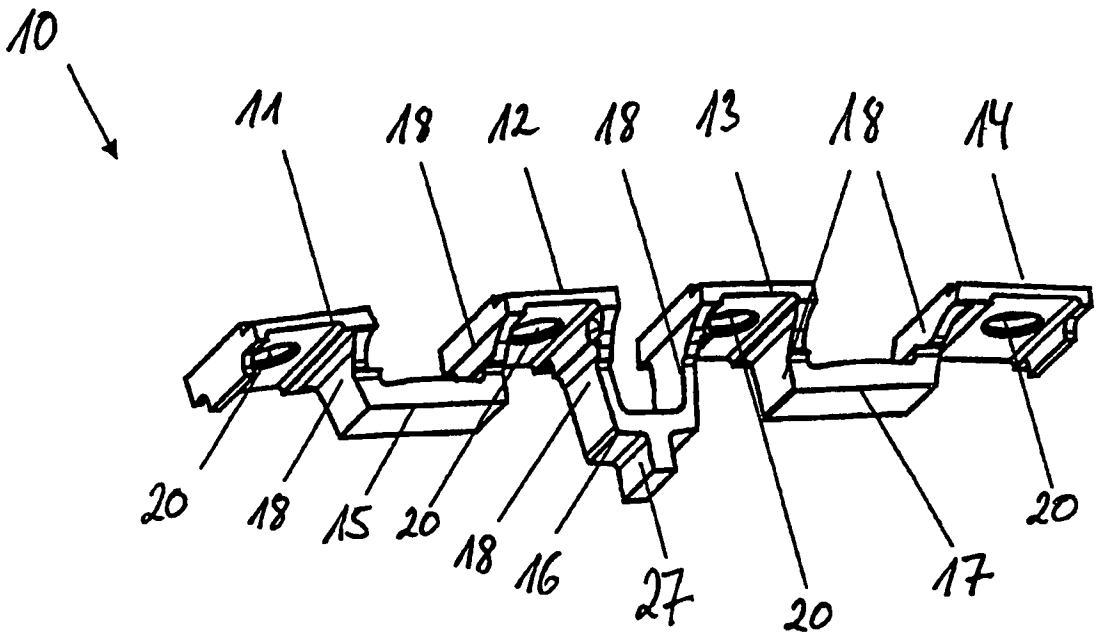
FIG. 1 shows a perspective view of a device for suspending gas channel elements according to the present invention.

FIG. 1 shows a device 10 according to the present invention for suspending gas channel elements on a housing of a gas turbine in a simple perspective view. Device 10 according to the present invention shown in FIG. 1 has multiple first plate-shaped elements 11, 12, 13, and 14 and multiple second plate-shaped elements 15, 16, and 17. First plate-shaped elements 11, 12, 13, and 14 are connected to second plate-shaped elements 15, 16, and 17 via web-like elements 18 extending approximately perpendicularly to same and form a meandering or crenelated profile.

A device according to an embodiment of the present invention for suspending gas channel elements has first plate-shaped elements and second plate-shaped elements, the first plate-shaped elements and the second plate-shaped elements being connected to one another via web-like elements extending approximately perpendicularly to same and forming a meandering or crenelated profile.

As is apparent in FIG. 1, second plate-shaped elements 15, 16, and 17 are positioned between two adjacent first plate-shaped elements 11 and 12, 12 and 13, as well as 13 and 14, respectively. Each of these second plate-shaped elements 15, or 16, or 17 is connected at its opposite ends to one of the two adjacent first plate-shaped elements 11 and 12, 12 and 13, as well as 13 and 14 via a web-like element 18. As mentioned above, web-like elements 18 extend approximately perpendicularly to first plate-shaped elements 11 through 14 and second plate-shaped elements 15 through 17. Web-like elements 18 extend over the entire width of first plate-shaped elements 11, 12, 13, 14 as well as over the entire width of second plate-shaped elements 15, 16, and 17 in the connecting area with same.

The above described meandering or crenelated profile or contour of device 10 according to the present invention for suspending gas channel elements on a housing of a gas turbine ensures to the highest possible degree the reduction of stresses due to temperature gradients which occur in the case of thermal differences between the relatively hot gas channel elements and the relatively cold housing. Web-like elements 18, which extend essentially at right angles or perpendicularly to plate-shaped elements 11 through 17, are deformed due to thermal stresses only in the elastic range so that no service life-reducing material stress occurs.

It should be noted in this connection that it is advantageous to design the web-like elements, which are used for connecting first plate-shaped elements 11 through 14 to second plate-shaped elements 15 through 17, to be as long as possible. This makes it possible to reduce the thermal stresses in device 10 according to the present invention particularly well.

Device 10 according to the present invention for suspending gas channel elements shown in FIG. 1 has four plate-shaped elements 11 through 14, three second plate-shaped elements 15 through 17, and six web-like elements 18 for connecting second plate-shaped elements 15 through 17 to first plate-shaped elements 11 through 14. When device 10 shown in FIG. 1 is used in a gas turbine, multiple such devices 10 are joined to form a ring-shaped suspension structure to fasten all required gas channel elements to the housing along the circumference of the housing. According to FIG. 1, device 10 is thus designed as a ring segment. In contrast to the shown exemplary embodiment, it is also possible to design device 10 according to the present invention directly in the form of a ring.

As mentioned repeatedly, device 10 according to the present invention is used for suspending gas channel elements on a housing of a gas turbine. First plate-shaped elements 11 through 14 are used for connecting device 10 according to the present invention to housing 19 of the gas turbine. This is particularly apparent in FIG. 2. For connecting device 10 according to the present invention to housing 19 of the gas turbine via first plate-shaped elements 11 through 14, boreholes 20 are introduced into first plate-shaped elements 11 through 14. Boreholes 20 are best seen in FIG. 1. Bolt-shaped fastening elements 21 assigned to housing 19 engage in boreholes 20 for mounting with housing 19. The meandering or crenelated contour of device 10 according to the present invention enables in this connection a very direct flow of force in the direction of arrow 22 (see FIG. 3 in particular) starting from fastening elements 21 into device 10 according to the present invention since the fastening elements are situated in the direct flow of force between housing 19 and device 10 according to the present invention. Therefore, bending stresses are reduced to a minimum within the scope of the present invention.

Figure 2:
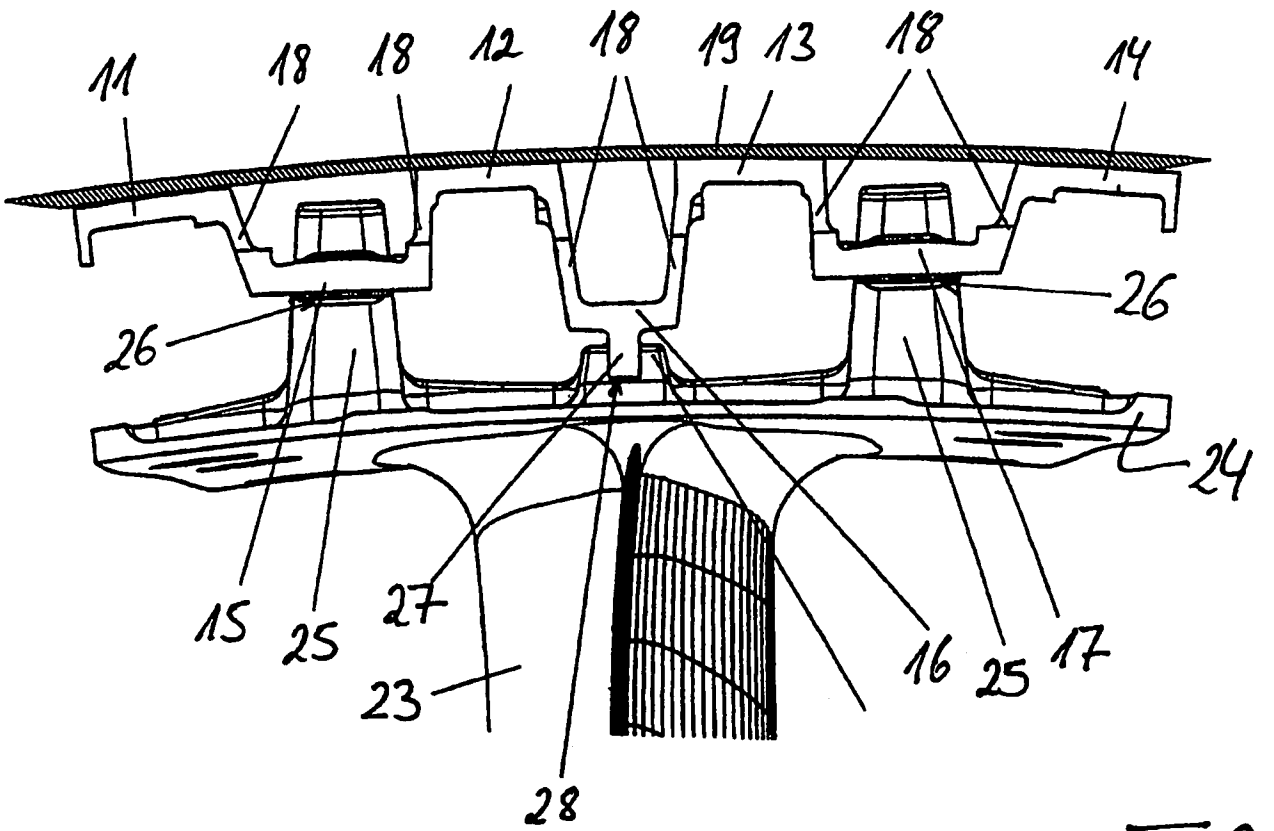
FIG. 2 shows the device for suspending gas channel elements according to the present invention together with a gas channel element and a housing of a gas turbine.
Figure 3:
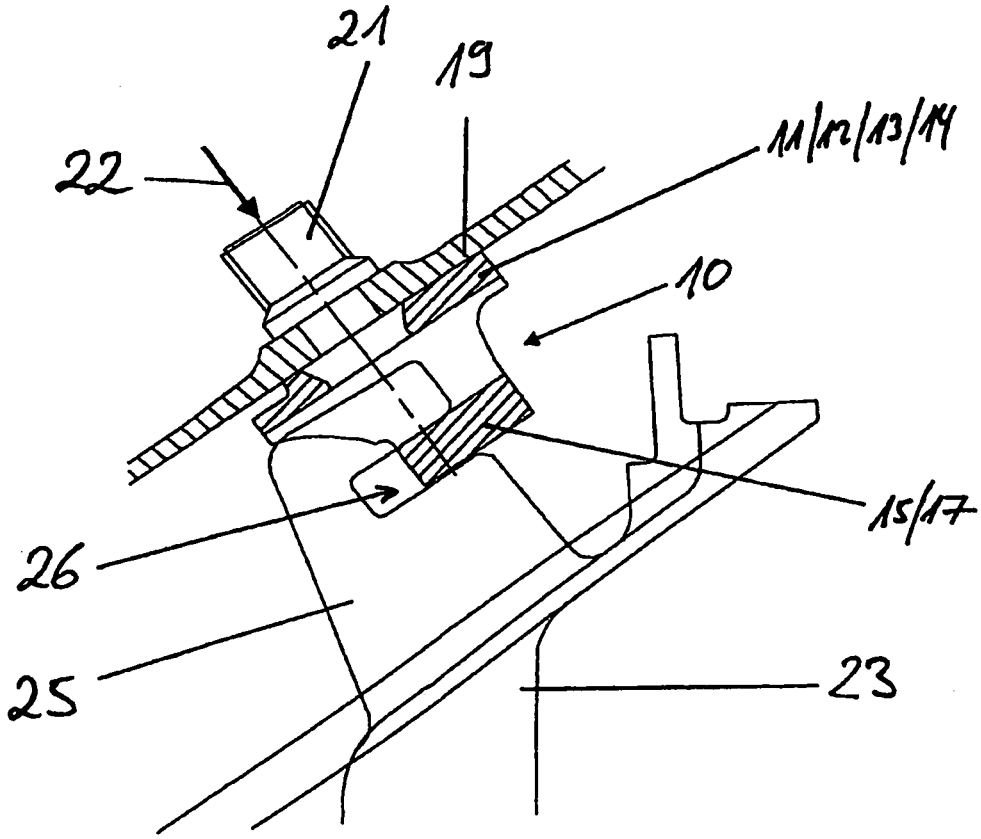
FIG. 3 shows a cross section through the system according to FIG. 2.

Second plate-shaped elements 15 through 17, which are situated offset opposite first plate-shaped elements 11 through 14, are used for connecting the device according to the present invention to at least one gas channel element. FIGS. 2 and 3 show a profiled support as such a gas channel element 23, multiple such profiled supports in a turbine-bearing intermediate housing, also referred to as a turbine center frame, forming a bearing star for bearing shafts and rotors of the gas turbine. It should be pointed out here that the device according to the present invention may of course be used for suspending other gas channel elements, e.g., gas channel plate segments or guide blade segments, or also individual guide blades and individual gas channel plates.

As is apparent in FIGS. 2 and 3 in particular, second plate-shaped elements 15 through 17 are used for the connection with gas channel element 23. For this purpose, second plate-shaped elements 15 through 17 are insertable into recesses assigned to gas channel element 23. In the shown exemplary embodiment, the two outer second plate-shaped elements 15 and 17 are used for the connection with gas channel element 23. Projections 25, which essentially extend outward in the radial direction, are assigned to an outer shroud band 24 of gas channel element 23, one recess 26 being introduced into each projection 25, the two outer plate-shaped elements 15 and 17 being insertable into the recesses. Gas channel element 23 is thus hooked into second plate-shaped elements 15 and 17 via recesses 26.

In the shown exemplary embodiment, a guide pin 27, which extends inward in the radial direction, is assigned to the middle second plate-shaped element 16. Guide pin 27 engages in a corresponding recess 28 which is assigned to outer shroud band 24 of gas channel element 23. Circumferential adjustment or circumferential centering of the gas channel element 23 is possible by guide pin 27 engaging in recess 28. As is apparent in FIG. 2 in this connection, the middle second plate-shaped element 16 is radially offset inward with respect to outer second plate-shaped elements 15 and 17.

The above connection of gas channel element 23 with device 10 according to the present invention has the advantage that fastening elements protruding into the gas channel, such as screws in which great thermal stresses are then induced, may be avoided. In addition, the above described fastening method makes a relative motion between gas channel element 23 and device 10 according to the present invention possible. This relative motion causes improved reduction in thermal circumferential stresses and may take on the function of a floating bearing in the flow direction.

The above described device according to the present invention may be manufactured in one piece as a casting using simple means. The one-piece design of device 10 according to the present invention makes simple assembly of same possible.

What is claimed is:

1. A device for suspending gas channel elements on a housing of a gas turbine, comprising a plurality of first plate-shaped elements connected to a plurality of second plate-shaped elements, the first plate-shaped elements and the second plate-shaped elements being connected to one another only by web-like elements, each web-like element extending approximately perpendicularly to the first and second plate shaped elements to which it is connected and forming a crenelated profile extending in a circumferential direction of the housing, a length of the housing in the circumferential direction being greater, by a multiple greater than one, than a length of the web-like element in an axial direction, and a gas channel element having at least one projection, each projection having a recess therein, each recess having one of the second plate-shaped elements inserted therein for connecting the gas channel element to said one of the second plate-shaped elements.

* * * * *